US011141332B2

(12) United States Patent
Davis

(10) Patent No.: US 11,141,332 B2
(45) Date of Patent: Oct. 12, 2021

(54) METHOD OF POSITIONING A PATIENT

(71) Applicant: D.T. Davis Enterprises, LTD., Allentown, PA (US)

(72) Inventor: David T. Davis, Bethlehem, PA (US)

(73) Assignee: D.T. Davis Enterprises, Ltd., Allentown, PA (US)

( * ) Notice: Subject to any disclaimer, the term of this patent is extended or adjusted under 35 U.S.C. 154(b) by 0 days.

(21) Appl. No.: 16/954,344

(22) PCT Filed: Dec. 21, 2018

(86) PCT No.: PCT/US2018/067102
§ 371 (c)(1),
(2) Date: Jun. 16, 2020

(87) PCT Pub. No.: WO2019/126650
PCT Pub. Date: Jun. 27, 2019

(65) Prior Publication Data

US 2021/0077325 A1 Mar. 18, 2021

Related U.S. Application Data

(60) Provisional application No. 62/609,427, filed on Dec. 22, 2017.

(51) Int. Cl.
*A61G 7/00* (2006.01)
*A61G 7/10* (2006.01)

(52) U.S. Cl.
CPC ..... *A61G 7/001* (2013.01); *A61G 7/1021* (2013.01); *A61G 7/1038* (2013.01)

(58) Field of Classification Search
None
See application file for complete search history.

(56) References Cited

U.S. PATENT DOCUMENTS

| | | | |
|---|---|---|---|
| 4,686,719 A | 8/1987 | Johnson et al. | |
| 2014/0007353 A1 | 1/2014 | Stryker et al. | |
| 2017/0216117 A1 | 8/2017 | Rigoni et al. | |
| 2019/0083341 A1* | 3/2019 | Ulreich | A61G 7/001 |

OTHER PUBLICATIONS

International Search Report and Written Opinion of corresponding International application PCT/US2018/067102; dated Apr. 15, 2019.

* cited by examiner

*Primary Examiner* — David R Hare
*Assistant Examiner* — Adam C Ortiz
(74) *Attorney, Agent, or Firm* — Duane Morris LLP

(57) ABSTRACT

The present disclosure provides a method of positioning a patient. The patient is provided on a support surface, an inflatable positioning mattress disposed between the patient and the support surface. Air flow into the inflatable positioning mattress is initiated to inflate the inflatable positioning mattress. A downward force is applied on the inflatable positioning mattress proximate to a first side of the support surface. A portion of the inflatable positioning mattress proximate to a second side of the support surface is raised. At least one wedge is positioned beneath the inflatable positioning mattress. Subsequently, the patient is lowered onto the at least one wedge.

17 Claims, 4 Drawing Sheets

METHOD OF POSITIONING A PATIENT

CROSS-REFERENCE TO RELATED APPLICATION

This application is a National Stage Application, filed under 35 U.S.C. 371, of International Patent Application No. PCT/US2018/067102, filed on Dec. 21, 2018, which claims the benefit of U.S. Provisional Application Ser. No. 62/609,427, filed on Dec. 22, 2017, entitled "METHOD OF POSITIONING A PATIENT," the disclosure of which is incorporated by reference herein in its entirety.

FIELD

The present invention relates to methods of positioning a patient, and more particularly to methods of turning a patient.

BACKGROUND

In the medical field, there is a continuing need to easily, safely and comfortably transport and position injured persons and hospital patients. Patient handling-related injuries among health care workers are a serious problem. The single greatest risk factor for musculoskeletal disorders in healthcare workers is the manual moving and repositioning of patients. Such operations often require that attendants have a high level of strength and skill to move and reposition the patient, regardless of the patient's size or weight.

Patient handling mattresses provide a useful way to move patients—particularly those patients who have fallen and are unable to get up without assistance—while at the same time reducing the risk of injury to the assisting caregiver. Patient handling mattresses are known in the art which include at least two flexible material sheets, that together define a plenum chamber, with at least one sheet being perforated with small pinholes over at least a central surface area, and which open up directly to the interior of the plenum chamber. Such prior art mattresses are used by arranging the perforated sheet so that it faces an underlying fixed, generally planar support surface, such as a floor or table. When the mattress is charged with pressurized air, the escape of air under pressure through the pinholes acts initially to jack a load placed upon the mattress above the perforated flexible sheet, and thereby creates an air bearing of relatively small height between the underlying fixed, generally planar support surface and the perforated flexible sheet.

In addition, patient positioning wedges are used to incline the patient relative to a support surface. For example, positioning wedges can be placed under the patient's right or left side to raise that side of the patient. This allows the patient to be maintained in this position during a procedure. Alternatively, the wedges may be used to incline the patient to increase the patient's comfort and to help reduce bedsores and other ailments resulting from prolonged periods in a single position. The use of wedges and positioning of a patient thereon may be physically difficult, especially for larger patients. In addition, the act of rotating the patient may cause the patient discomfort and stress.

SUMMARY

The present disclosure provides a method of positioning a patient. The patient is provided on a support surface with an inflatable positioning mattress disposed between the patient and the support surface. Air flow into the inflatable positioning mattress is initiated to inflate the inflatable positioning mattress. A downward force is applied on the inflatable positioning mattress proximate to a first side of the support surface. A portion of the inflatable positioning mattress proximate to a second side of the support surface is raised. At least one wedge is positioned beneath the inflatable positioning mattress. Subsequently, the patient is lowered onto the at least one wedge.

In some embodiments, air flow to the positioning mattress is terminated after the portion of the inflatable positioning mattress proximate to the second side of the support surface is raised.

In some embodiments, after the air flow to the mattress is initiated, the mattress and the patient are translated toward the second side of the support surface.

In some embodiments, the method includes the step of inserting an air hose into a receptacle of the inflatable positioning mattress proximate a foot-end of the inflatable positioning mattress.

In some embodiments, a first wedge and a second wedge are inserted beneath the inflatable positioning mattress. The first wedge can be positioned superior to the sacrum of the patient and the second wedge can be positioned inferior to the sacrum of the patient.

In some embodiments, a first caregiver applies the downward force proximate the first side of the support surface and a second caregiver raises the mattress proximate the second side of the support surface.

In some embodiments, the downward force is applied proximate the shoulder and the hip of the patient.

BRIEF DESCRIPTION OF THE DRAWINGS

These and other features and advantages of the present invention will be more fully disclosed in, or rendered obvious by, the following detailed description of the preferred embodiments of the invention, which is to be considered together with the accompanying drawings wherein like numbers refer to like parts and further wherein.

DETAILED DESCRIPTION

Figure 1:
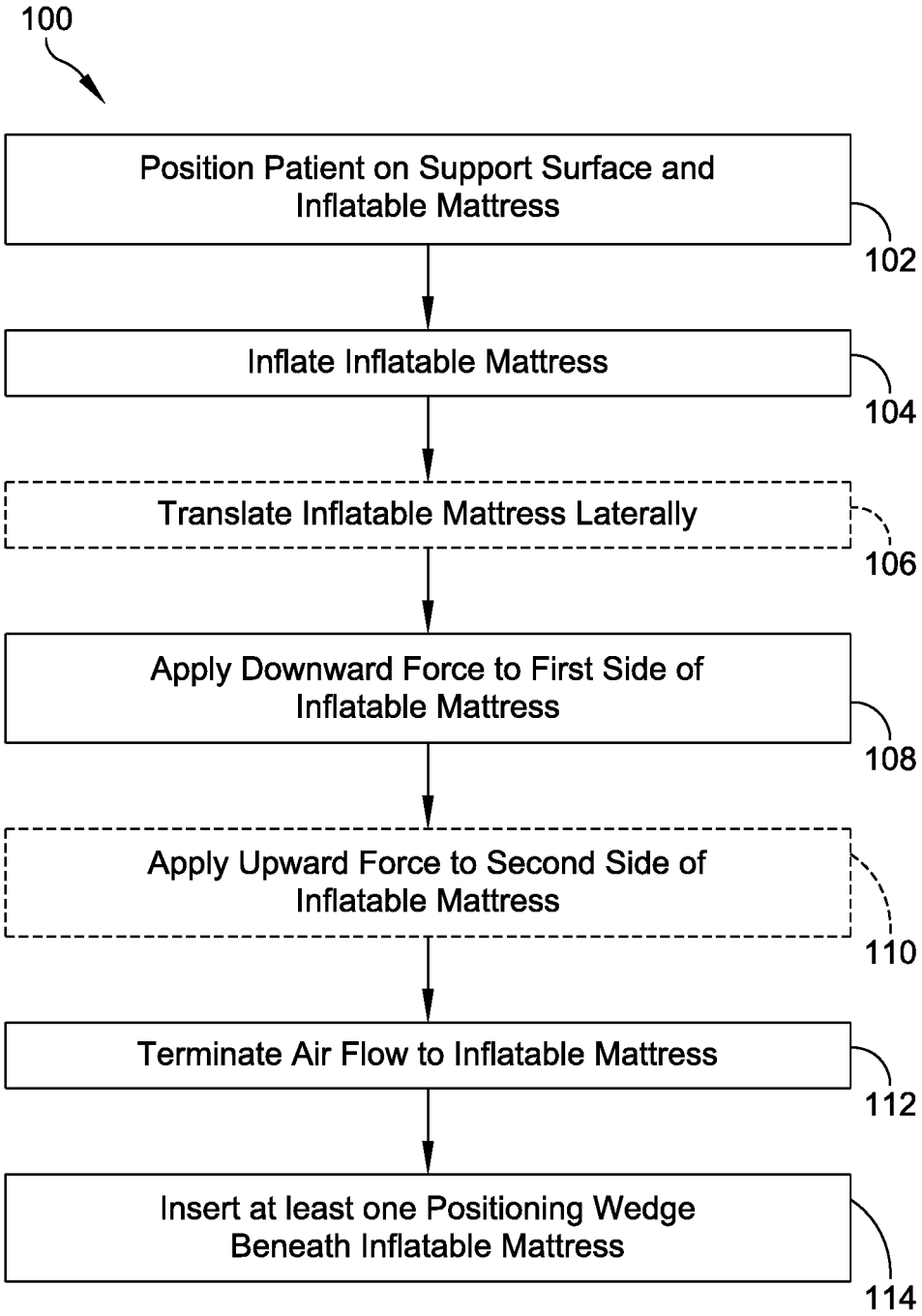
FIG. 1 is a flowchart illustrating a method of positioning a patient, in accordance with some embodiments.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship.

The present disclosure provides a method of elevating a portion of a patient. Such elevation may be desired in order to position a patient for a procedure. Alternatively, the elevation and associated rotation of the patient may help reduce bedsores and other complications associated with a patient being in bed for prolonged periods of time. The methods described herein are less physically demanding of the caregivers than currently practiced procedures. Additionally, the methods described herein are less stressful and/or painful for the patient.

Figure 2:
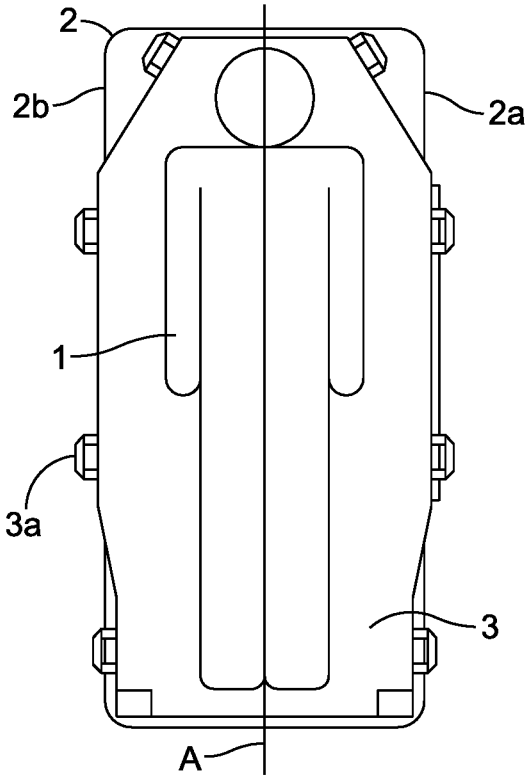
FIG. 2 illustrates a patient and a positioning mattress centered on a support surface, in accordance with some embodiments.

FIG. 1 is a flowchart illustrating a method 100 of positioning a patient. FIGS. 2-5 illustrate various steps of the method 100, in accordance with some embodiments. At step 102, a patient 1 is positioned on a support surface 2 and an inflatable positioning mattress 3, as illustrated in FIG. 2. The inflatable positioning mattress 3 is disposed between the patient 1 and the support surface 2. The patient 1 may be in a prone, supine, and/or other suitable position. The support surface 2 may be a hospital bed, gurney, cot, stretcher, and/or any other structure able to support the patient 1. The inflatable positioning mattress 3 may be any mattress capable of being inflated with air from a pressurized air source. In some embodiments, the inflatable positioning mattress 3 includes at least two flexible material sheets, that together define a plenum chamber, with at least one sheet being perforated with small pinholes over at least a central surface area, and which open up directly to the interior of the plenum chamber. When pressurized, air can escape through the small pinholes and, thereby, create a layer of air, or air bearing, upon which the inflatable positioning mattress 3 can be easily translated with respect to the support surface 2. The inflatable positioning mattress 3 may additionally include a plurality of handles 3*a* mounted along the perimeter of the inflatable positioning mattress 3.

Figure 3:
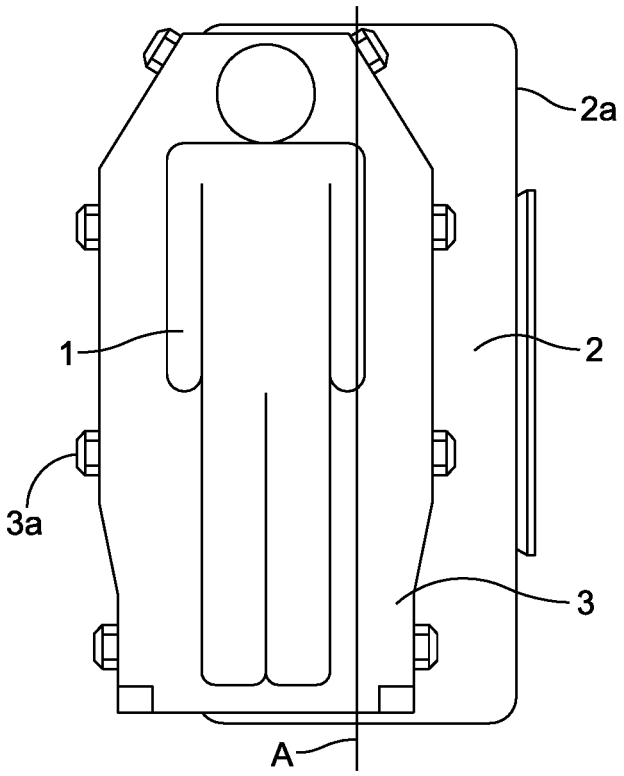
FIG. 3 illustrates the patient and the positioning mattress positioned to one side of the support surface, in accordance with some embodiments.

At step 104 of method 100, the inflatable positioning mattress 3 is at least partially inflated. In some embodiments, air flow into the positioning mattress 3 is initiated from an air source coupled to and configured to inflate the inflatable positioning mattress 3. As a result of this inflation, the patient 1 is vertically elevated with respect to the support surface 2. Prior to initiating air flow into the mattress 3, an air hose of the air source may be inserted into a receptacle near the foot end of the inflatable positioning mattress 3 and/or otherwise coupled to the inflatable positioning mattress 3. At optional step 106, the patient 1 and the inflatable positioning mattress 3 are translated laterally such that the center of the patient 1 is positioned to one side of the center line A of the support surface 2, as shown in FIG. 3. In some embodiments, this lateral translation is in the direction of a side of the patient 1 which is to be elevated. Lateral translation allows the patient 1 to be more closely centered on the support surface 2 after rotation.

Figure 4:
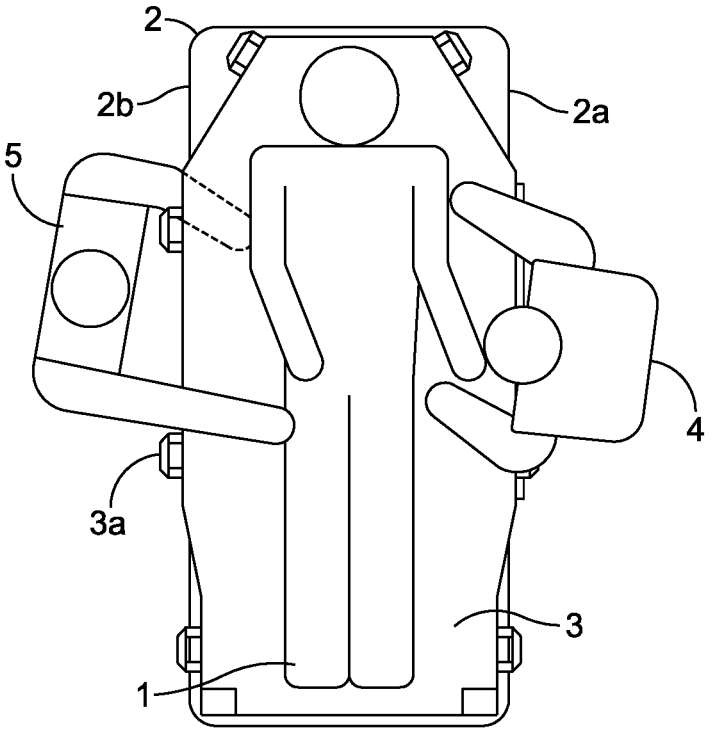
FIG. 4 illustrates a first caregiver applying a force to the positioning mattress adjacent a first side of the patient and a second caregiver applying an opposite force on the positioning mattress adjacent a second side of the patient, in accordance with some embodiments.
Figure 5:
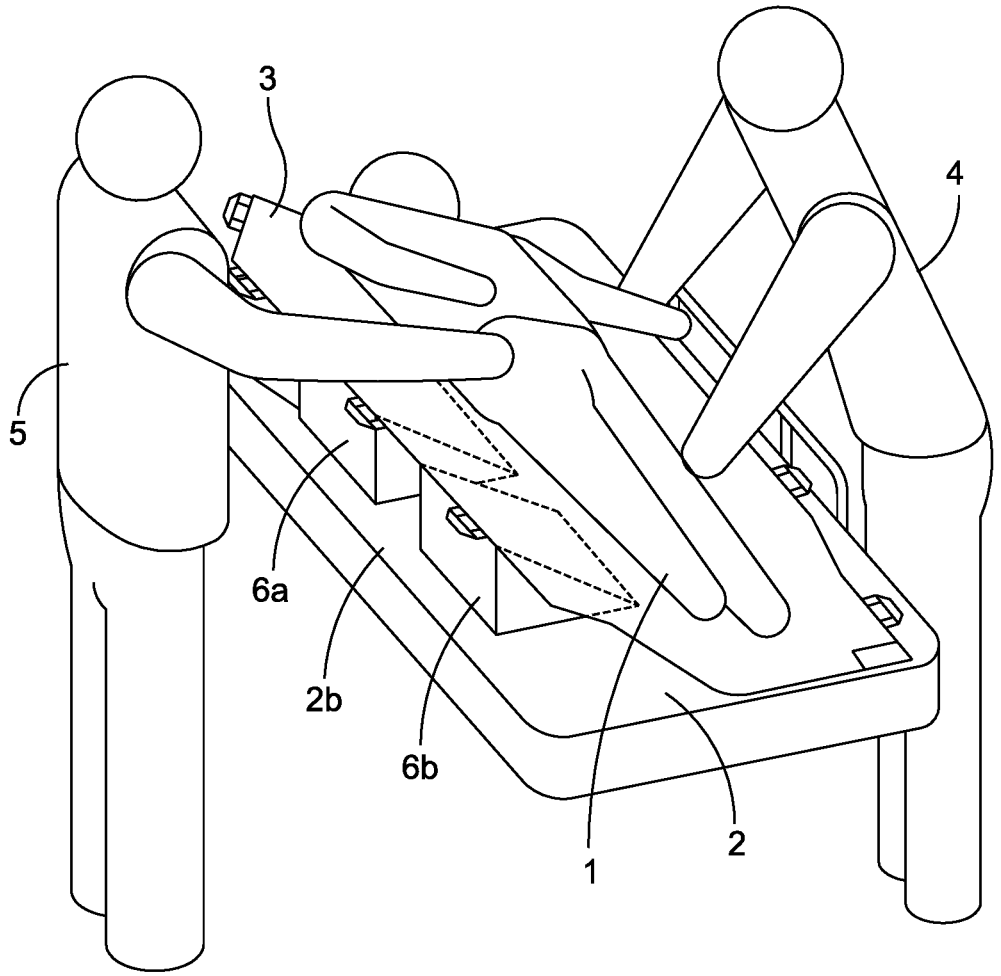
FIG. 5 illustrates positioning wedges disposed beneath the patient and the positioning mattress, in accordance with some embodiments.

At step 108, a downward force is applied to a top surface of the inflatable positioning mattress 3 proximate to a first side 2*a* of the support surface 2. As illustrated in FIG. 4, in some embodiments, the downward force is applied by a first caregiver 4 by pressing on the inflatable positioning mattress 3. In some embodiments, the force is applied proximate the shoulder and the hip of the patient 1, although it will be appreciated that the downward force can be applied to any portion of the top surface of the inflatable positioning mattress 3. At optional step 110, an upward force is applied to a portion of the inflatable positioning mattress 3 proximate to a second side 2*b* of the support surface 2. As illustrated in FIG. 4, in some embodiments, a second caregiver 5 applies the upward force by raising a portion of the mattress 3. The second caregiver 5 can apply this upward force using the handles 3*a*.

At step 112, the air flow to the inflatable positioning mattress 3 is terminated. The downward force applied to the first side 2*a* of the inflatable positioning mattress 3 and/or the upward force applied to the second side 2*b* of the inflatable positioning mattress 3 causes displacement of the air within the inflatable positioning mattress 3 from the first side 2*a* toward the second side 2*b*. The displacement of air within the inflatable positioning mattress 3 acts to lift a side of the patient 1 proximate the second side 2*b* of the support surface 2 such that the patient 1 is turned toward the first side 2*a* of the inflatable positioning mattress 3. Turning of the patient 1 using movement of air within the inflatable positioning mattress 3 reduces the burden on the caregivers and makes the process more comfortable for the patient 1.

At step 114, at least one positioning wedge 6 is inserted beneath the patient 1 and the inflatable positioning mattress 3 to maintain the patient 1 in a rotated position, as shown in FIG. 4. In some embodiments, the second caregiver 5 can insert the at least one positioning wedge 6 beneath the patient and the inflatable positioning mattress 3. In the illustrated embodiment, the at least one positioning wedge 6 is substantially in the shape of a triangular prism, e.g., the apex of the triangular prism, although it will be appreciated that other shapes may be used and are within the scope of this disclosure. In some embodiments, a first wedge 6*a* and a second wedge 6*b* are inserted beneath the inflatable positioning mattress 3. The first wedge 6*a* can be positioned superior to the sacrum of the patient 1 and the second wedge 6*b* can be positioned inferior to the sacrum of the patient 1. The first wedge 6*a* and the second wedge 6*b* can be positioned approximately three inches above and below the sacrum, respectively, although it will be appreciated that other placements and/or positions can be used and are within the scope of this disclosure After placement of the positioning wedges, the patient 1 can be lowered onto the wedges 6*a*, 6*b* and the remaining air within the mattress 3 may be allowed to escape. The positioning wedges can include a non-skid coating to ensure that the patient and the mattress do not slide down the wedges. Although the steps 102-114 of the method 100 are illustrated as distinct steps, it will be appreciated that any two or more of the disclosed steps may be performed simultaneously. For example, steps 108 and 110 may be performed together to apply a downward force and an upward force to the inflatable positioning mattress 3 simultaneously.

Figure 6:
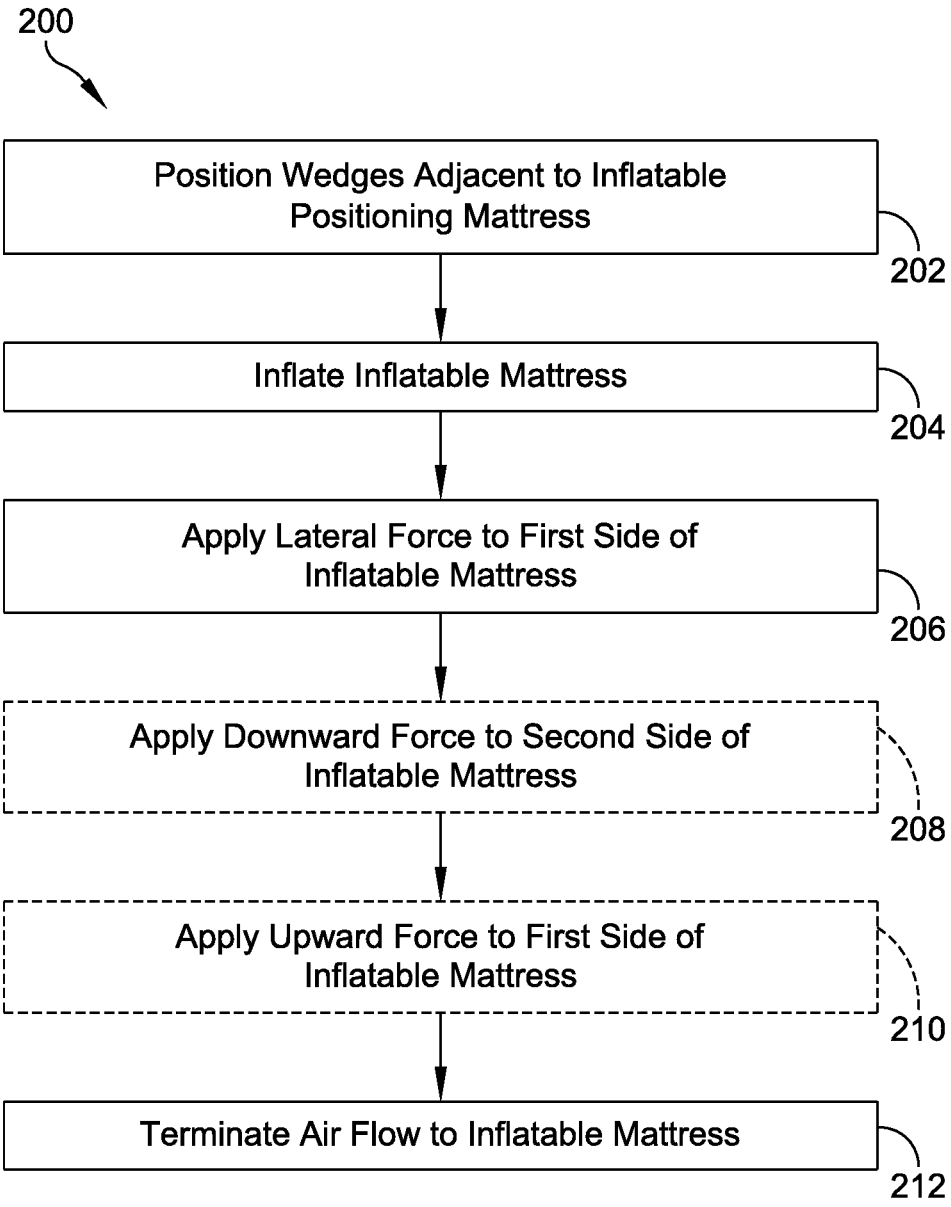
FIG. 6 is a flowchart illustrating a method of positioning a patient, in accordance with some embodiments.

FIG. 6 is a flowchart illustrating a method 200 of positioning a patient 1 using an inflatable positioning mattress 3, in accordance with some embodiments. At step 202, one or more positioning wedges 6 are positioned next to an inflatable positioning mattress 3 disposed between a patient 1 and a support surface 2. At step 204, the inflatable positioning mattress 3 is at least partially inflated to create an air bearing between support surface 2 and the inflatable positioning mattress 3, as described herein. Air flow from an air source, such as an air hose coupled to the inflatable positioning mattress 3 as described above, flows into the plenum chamber of the inflatable positioning mattress 3 and exits through the plurality of pinholes formed in at least one sheet of the inflatable positioning mattress 3. The air flow through the pinholes forms an air bearing between the inflatable positioning mattress 3 and the support surface 2.

At step 206, a lateral force is applied to the inflatable positioning mattress 3 to laterally translate the inflatable positioning mattress 3 and the patient 1 onto the one or more positioning wedges 6. For example, in some embodiments, a lateral force is applied by a caregiver using one or more handles 3*a* formed integrally with the inflatable positioning mattress 3. Because the air bearing created beneath the inflatable positioning mattress 3 reduces the force required to move the patient 1, the caregiver can easily pull the patient 1 onto the positioning wedges 6 and thus rotate the patient 1. In such an embodiment, the positioning wedges 6 can be relatively smooth, without a non-skid material, such that the inflatable positioning mattress 3 can be translated thereon without significant resistance.

At optional step 208 a downward force is applied to a second side of the inflatable positioning mattress 3 opposite the first side. The downward force causes the patient 1 to rotate on the inflatable positioning mattress 3 as described above. At optional step 210, an upward force is applied to the first side of the inflatable positioning mattress 3. The upward force causes the patient 1 to rotate and the first side of the inflatable positioning mattress 3 to raise above the support surface 2.

At step 212, the inflatable positioning mattress 3 is deflated to lower the patient 1 onto the one or more positioning wedges 6. The patient 1 is maintained in the rotated position by the one or more positioning wedges 6. Although the steps 202-212 of the method 200 are illustrated as distinct steps, it will be appreciated that any two or more of the disclosed steps may be performed simultaneously. For example, steps 206, 208 and 210 may be performed together to apply a lateral force, a downward force and an upward force to the inflatable positioning mattress 3 simultaneously.

It is to be understood that the present disclosure is by no means limited only to the particular constructions, steps, and operations herein disclosed and shown in the drawings, but also comprises any modifications or equivalents within the scope of the claims. The appended claims should be construed broadly, to include other variants and embodiments, which may be made by those skilled in the art.

What is claimed is:

1. A method of positioning a patient, the method comprising: providing the patient on a support surface, an inflatable mattress disposed between the patient and the support surface; initiating air flow into the inflatable mattress to inflate the inflatable mattress; applying a downward force, wherein the downward force is applied by a first caregiver and an upward force is applied by a second caregiver, on the inflatable mattress proximate to a first side of the support surface; inserting at least one wedge beneath the inflatable positioning mattress; and lowering the patient onto the at least one wedge.

2. The method of claim 1, comprising terminating air flow into the inflatable positioning mattress.

3. The method of claim 2, wherein the air flow is terminated prior to applying the downward force.

4. The method of claim 1, comprising sliding the patient and the inflatable positioning mattress toward the second side of the support surface prior to applying the downward force.

5. The method of claim 1, comprising raising a portion of the inflatable mattress proximate to a second side of the support surface.

6. The method of claim 5, wherein the applying step is performed by a first caregiver and the raising step is performed by a second caregiver.

7. The method of claim 1, comprising inserting an air hose into a receptacle of the inflatable positioning mattress proximate a foot-end of the inflatable positioning mattress, wherein the air hose is configured to provide the air flow into the inflatable mattress.

8. The method of claim 1, the at least one wedge comprises a first wedge and a second wedge.

9. The method of claim 8, wherein the first wedge is positioned superior to the sacrum of the patient and the second wedge is positioned inferior to the sacrum of the patient.

10. The method of claim 1, wherein during the applying step the downward force is applied proximate the shoulder and the hip of the patient.

11. A method of positioning a patient, the method comprising: positioning the patient on an inflatable mattress located on a support surface, wherein the inflatable mattress comprises a first flexible material sheet and a second flexible material sheet coupled together to define a plenum chamber, wherein the second flexible material sheet defines a plurality of holes over at least a central surface area; initiating air flow into the plenum chamber to inflate the inflatable mattress, wherein a portion of the air flow exits the plenum chamber through the plurality of holes to form an air bearing between the inflatable mattress and the support surface; applying a lateral force, to a first side of the inflatable mattress, wherein the lateral force moves the inflatable mattress in a lateral direction onto at least one positioning wedge; applying a downward force to a second side of the inflatable mattress; applying an upward force to the first side of the inflatable mattress; wherein the downward force is applied by a first caregiver and the upward force is applied by a second caregiver and lowering the patient onto the at least one positioning wedge.

12. The method of claim 11, comprising terminating air flow into the inflatable positioning mattress.

13. The method of claim 11, comprising inserting an air hose into a receptacle of the inflatable positioning mattress proximate a foot-end of the inflatable positioning mattress, wherein the air hose is configured to provide the air flow into the inflatable mattress.

14. The method of claim 11, the at least one wedge comprises a first wedge and a second wedge.

15. The method of claim 14, wherein the first wedge is positioned superior to the sacrum of the patient and the second wedge is positioned inferior to the sacrum of the patient.

16. A method of positioning a patient, comprising: positioning the patient on an inflatable mattress located on a support surface, wherein the inflatable mattress comprises a first flexible material sheet and a second flexible material sheet coupled together to define a plenum chamber, wherein the second flexible material sheet defines a plurality of holes over at least a central surface area; initiating air flow into the inflatable mattress to inflate the inflatable mattress, wherein a portion of the air flow exits the plenum chamber through the plurality of holes to form an air bearing between the inflatable mattress and the support surface; applying a downward force, wherein the downward force is applied by a first caregiver and an upward force is applied by a second caregiver, to a first side of the inflatable mattress; inserting a first wedge and a second wedge beneath a second side of the inflatable positioning mattress, wherein the first wedge is positioned superior to a sacrum of the patient and the second wedge is positioned inferior to the sacrum of the patient; and lowering the patient onto the first wedge and the second wedge.

17. The method of claim 16, comprising:

applying an upward force to a second side of the inflatable mattress; and applying a lateral force to the second side of the inflatable mattress, wherein the lateral force transitions the inflatable mattress onto the first wedge, the second wedge, or both the first wedge and the second wedge.

* * * * *